US010196171B2

(12) United States Patent
Fisher et al.

(10) Patent No.: US 10,196,171 B2
(45) Date of Patent: Feb. 5, 2019

(54) CARTON HAVING INTEGRATED POUCH CUP FOR MEAL PREPARATION AND CONSUMPTION AND METHOD FOR PRODUCING SAME

(71) Applicant: Malnove Incorporated of Florida, Jacksonville, FL (US)

(72) Inventors: Ramsey Fisher, Jacksonville, FL (US); Leo Quinones, Jacksonville, FL (US); Mark Kocovsky, Jacksonville, FL (US); Anthony Shun, Jacksonville, FL (US); Donald L. Scott, Alpharetta, GA (US)

(73) Assignee: Malnove Incorporated, Omaha, NE (US)

( * ) Notice: Subject to any disclaimer, the term of this patent is extended or adjusted under 35 U.S.C. 154(b) by 258 days.

(21) Appl. No.: 15/312,487

(22) PCT Filed: May 21, 2015

(86) PCT No.: PCT/US2015/031989

§ 371 (c)(1),
(2) Date: Nov. 18, 2016

(87) PCT Pub. No.: WO2015/179651

PCT Pub. Date: Nov. 26, 2015

(65) Prior Publication Data

US 2018/0215503 A1 Aug. 2, 2018

Related U.S. Application Data

(60) Provisional application No. 62/001,318, filed on May 21, 2014.

(51) Int. Cl.
*B65D 5/60* (2006.01)
*B65D 81/34* (2006.01)
(Continued)

(52) U.S. Cl.
CPC ..... *B65D 5/606* (2013.01); *B31B 50/20* (2017.08); *B31B 50/26* (2017.08); *B31B 50/624* (2017.08);
(Continued)

(58) Field of Classification Search
CPC .... B65D 5/606; B65D 5/0227; B65D 5/3628; B65D 5/5405; B65D 81/3453;
(Continued)

(56) References Cited

U.S. PATENT DOCUMENTS 2,758,520 A 8/1956 Hepworth
3,147,675 A 9/1964 Cherrin
(Continued)

*Primary Examiner* — Christopher Demeree
(74) *Attorney, Agent, or Firm* — Cozen O'Connor

(57) ABSTRACT

A carton, formed from a blank, has an integrated pouch cup for meal preparation and consumption. The blank comprises a main panel, a first side panel adjoining the main panel along a first fold line, and a second side panel adjoining the main panel along a second fold line. A bottom panel adjoins the main panel along a third fold line. The bottom panel has first and second bottom sections having a crease in between. The bottom panel further comprising an attachment tab section which extends from the second bottom section. The bottom panel has a width which is less than the width of the main panel so as to form open edge portions at a bottom edge of the main panel on both sides of the bottom panel, the open edge portions extending to the first and second fold lines.

19 Claims, 11 Drawing Sheets

(51) Int. Cl.

| | |
|---|---|
| ***B65D 85/816*** | (2006.01) |
| ***B65D 5/54*** | (2006.01) |
| ***B65D 5/02*** | (2006.01) |
| ***B31B 50/20*** | (2017.01) |
| ***B31B 50/26*** | (2017.01) |
| ***B31B 50/62*** | (2017.01) |
| ***B31B 50/81*** | (2017.01) |
| ***B65D 5/36*** | (2006.01) |
| *B31B 120/30* | (2017.01) |
| *B31B 110/35* | (2017.01) |
| *B31B 120/40* | (2017.01) |

(52) U.S. Cl.
CPC ..... *B31B 50/81* (2017.08); *B65D 5/0227* (2013.01); *B65D 5/3628* (2013.01); *B65D 5/5405* (2013.01); *B65D 81/3453* (2013.01); *B65D 85/816* (2013.01); *B31B 2110/35* (2017.08); *B31B 2120/302* (2017.08); *B31B 2120/402* (2017.08)

(58) Field of Classification Search
CPC .. B65D 85/816; B65D 85/8043; B65D 5/067; B65D 81/34; B65D 81/3415; B31B 50/20; B31B 50/624; B31B 50/81; B31B 50/26
USPC ..... 426/115, 112, 113, 86; 206/217, 218, 206/219; 229/400, 404, 401, 402, 403, 229/200, 4.5, 904; 220/23.91, 276
See application file for complete search history.

(56) References Cited

U.S. PATENT DOCUMENTS

| | | | | |
|---|---|---|---|---|
| 3,693,192 | A | 9/1972 | Knotts | |
| 3,899,118 | A * | 8/1975 | Hollinger | B65D 5/726 221/199 |
| 3,976,795 | A * | 8/1976 | Ando | B65D 75/004 426/115 |
| 5,605,710 | A * | 2/1997 | Pridonoff | A47J 31/02 206/0.5 |
| 6,050,482 | A | 4/2000 | Cai | |
| 6,053,402 | A * | 4/2000 | Thomas | B65D 5/067 229/120.011 |
| 7,273,162 | B2 * | 9/2007 | Baker | B65D 5/18 229/103 |
| 2003/0080120 | A1 * | 5/2003 | Whitmore | B65D 5/029 219/730 |
| 2006/0180644 | A1 | 8/2006 | Baker | |
| 2012/0261413 | A1 * | 10/2012 | Bossel | B65D 5/3628 220/23.91 |

* cited by examiner

CARTON HAVING INTEGRATED POUCH CUP FOR MEAL PREPARATION AND CONSUMPTION AND METHOD FOR PRODUCING SAME

CROSS-REFERENCE TO RELATED APPLICATION

This is a U.S. National Phase Application under 35 USC 371 of International Application PCT/US2015/031989 filed on May 21, 2015, which claims priority to U.S. Provisional Patent Application No. 62/001,318, filed May 21, 2014, both of which are hereby incorporated by reference.

FIELD OF THE INVENTION

The disclosed embodiments relate to a carton having an integrated pouch cup for meal preparation and consumption. Specifically, the disclosed embodiments relate to a cup, pouch, or bowl package for preparation and consumption of cold or hot foods which forms part of a package and is made from a web-fed or pre-made gusseted flexible pouch.

BACKGROUND OF THE INVENTION

FIGS. 20 and 21 depict a conventional package for the preparation and consumption of a food product. In particular, these figures depict a collapsible-cup package for instant soups. A consumer can remove the top portion 302 of the package and pour hot water into the pouch to reconstitute the soup powder. However, as shown in FIG. 20, the collapsible-cup package requires side portions 304*a* and 304*b* that cannot be used for holding the contents of the package (i.e., because the front and back faces of the package are sealed together in these portions and therefore do not provide an interior volume), yet these side portions occupy considerable space on the retail shelves. More significantly, as shown in FIG. 21, the bottom of the package is formed of a complex interlocking structure which forms a hexagonal-shaped base. Due to this configuration, the assembled cup does not hold its standing position very well and often lose its structural posture after an initial assembly.

SUMMARY OF THE INVENTION

The disclosed embodiments deliver many benefits over conventional pouches, cups and bowls. For example, cartons in accordance with the disclosed embodiments can be formed, filled, and sealed using conventional packing equipment. The relatively flat form factor delivers at least a 50% reduction in the volume occupied by the filled packaging on retail shelves versus conventional cup and bowl-type packages. The carton is easy to open and allows consumers to prepare and consumed a meal in the carton in which the food product is purchased. In the opened and deployed configuration, the carton provides a safe and stable package for consuming hot foods and liquids. Also, the packaging is easy to breakdown into its separate components for ease of recycling the materials.

In one aspect, the disclosed embodiments provide a blank for forming a carton with an integrated pouch cup. The blank comprises a main panel having a width and a height, the main panel having a perforated section at a top portion thereof. The blank further comprises a first side panel adjoining the main panel along a first fold line, the first fold line extending in a height direction of the main panel. The first side panel has a perforated section at a top portion thereof. The blank further provides a second side panel adjoining the main panel along a second fold line, the second fold line extending in the height direction of the main panel. The second side panel is positioned on a side of the main panel opposite the first side panel in a width direction of the main panel. The second side panel has a perforated section at the top portion thereof.

A bottom panel adjoins the main panel along a third fold line, the third fold line extending in a width direction of the main panel. The bottom panel is positioned on a side of the main panel opposite the perforated section of the main panel. The bottom panel has first and second bottom sections having a crease in between. The first bottom section adjoins the main panel at the third fold line. The bottom panel further comprises an attachment tab section which extends from the second bottom section. The bottom panel has a width which is less than the width of the main panel so as to form open edge portions at a bottom edge of the main panel on both sides of the bottom panel, the open edge portions extending to the first and second fold lines.

In another aspect, the disclosed embodiments provide a carton having an integrated pouch cup formed from a blank as described above. The first and second side panels are folded onto the main panel so as to at least partially overlap and are adhered to one another.

In particular embodiments, the carton may comprise a gusseted pouch positioned in an interior portion of carton. The crease of the bottom panel may be folded in a direction opposite to a direction in which the first and second side panels fold along the first and second fold lines so that the crease is positioned within a gusset along a bottom edge of the gusseted pouch. A first sidewall region near the first fold line and a second sidewall region near the second fold line may be configured to become sidewalls of the carton by pushing the first and second fold lines inward in the width direction of the main panel to transform the carton into its deployed configuration to have an integrated pouch cup.

In another aspect, the disclosed embodiments provide a method of forming a carton having an integrated pouch cup. The method includes providing a blank as described above. The method includes folding the first and second side panels onto the main panel so as to at least partially overlap and adhering the first and second panels to one another. The method further includes folding the crease of the bottom panel in a direction opposite to a direction in which the first and second side panels are folded along the first and second fold lines. The method further includes adhering the attachment tab section of the bottom panel to the adhered first and second side panels. The method further includes applying compression to the first and second fold lines in a width direction of a panel to create an interior space between the main panel and the adhered first and second side panels. The method further includes inserting a gusseted pouch into the interior space between the main panel and the adhered first and second side panels so that the crease of the bottom panel is positioned within a gusset along a bottom edge of the gusseted pouch.

In another aspect, the disclosed embodiments provide a method of forming a carton having an integrated pouch cup. The method includes providing a blank as described above. The method further includes attaching a gusseted pouch to the main panel so that an area of the pouch falls entirely within an area of the main panel. The method further includes folding the first and second side panels over the gusseted pouch so as to at least partially overlap and adhering the first and second panels to one another. The method further includes folding the crease of the bottom panel in a direction opposite to a direction in which the first and second side panels are folded along the first and second fold lines so that the crease of the bottom panel is positioned within a gusset along a bottom edge of the gusseted pouch. The method further includes adhering the attachment tab section of the bottom panel to the adhered first and second side panels.

BRIEF DESCRIPTION OF THE DRAWINGS

The following description, given with respect to the attached drawings, may be better understood with reference to the non-limiting examples of the drawings, wherein.

DETAILED DESCRIPTION

Figure 1:
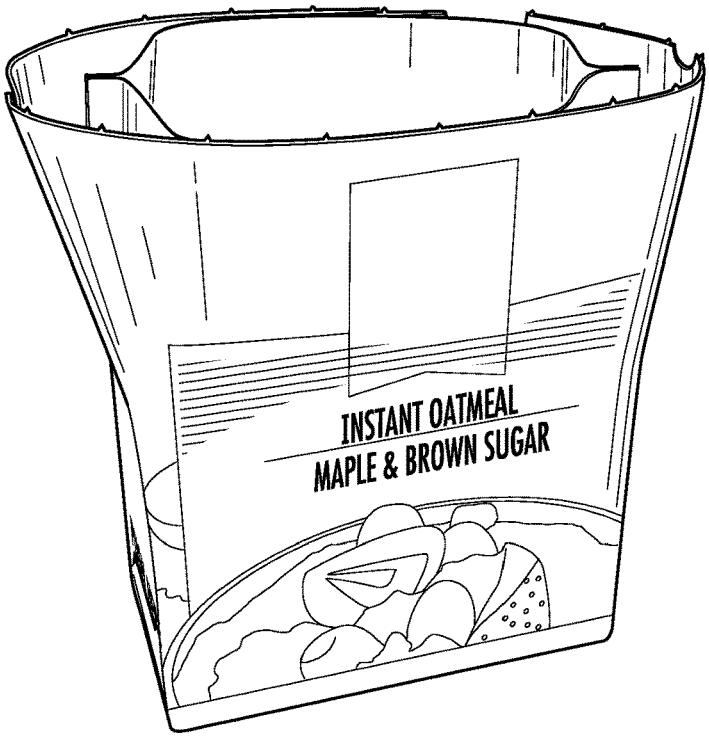
FIG. 1 is a front perspective view of a carton having an integrated pouch cup for meal preparation and consumption in the opened and deployed configuration of the carton.
Figure 2:
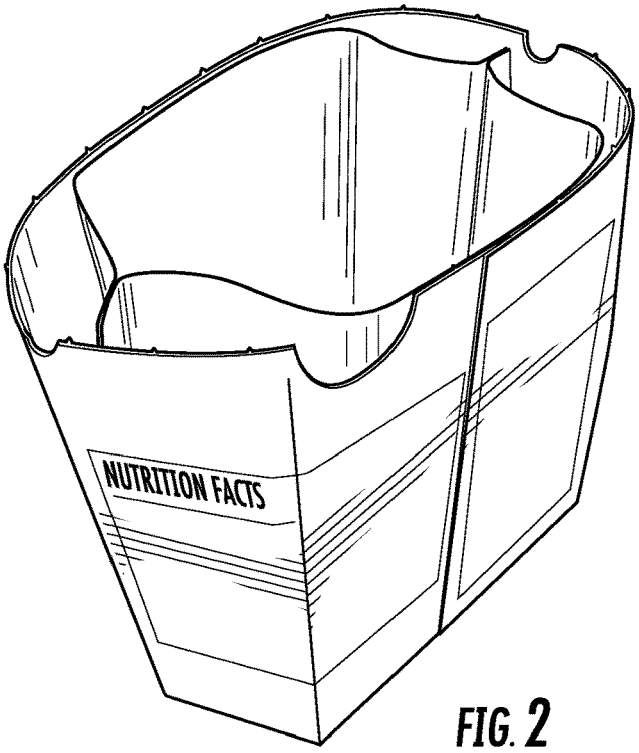
FIG. 2 is a rear perspective view of the carton of FIG. 1.

FIG. 1 is a front perspective view of a carton having an integrated pouch cup for meal preparation and consumption in its opened and deployed configuration. FIG. 2 is a rear perspective view of the carton of FIG. 1.

Figure 3:
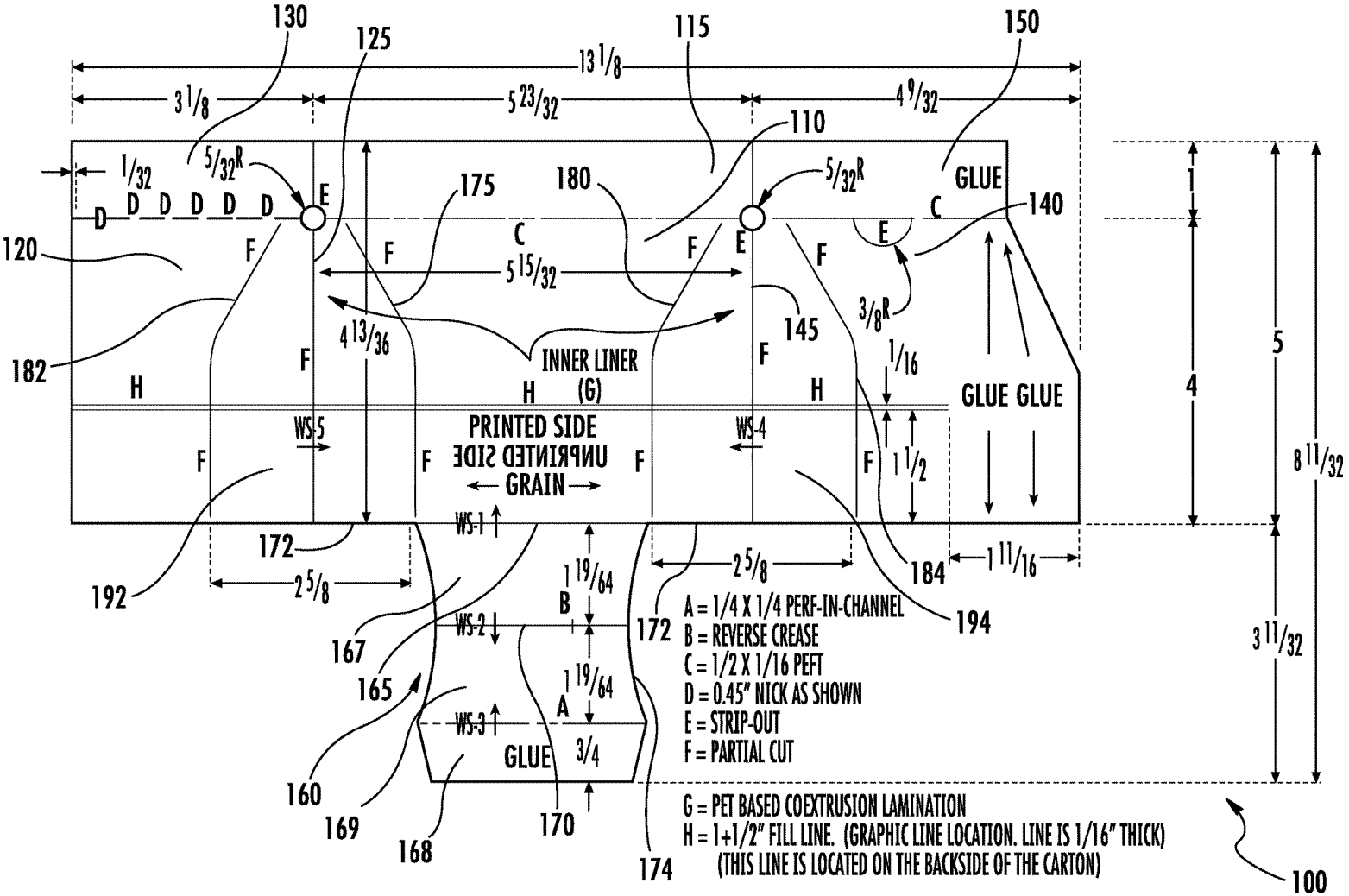
FIG. 3 depicts a paperboard blank used to form a carton in accordance with the disclosed embodiments.

FIG. 3 depicts a paperboard blank used to form a carton in accordance with the disclosed embodiments. More specifically, the figure shows an embodiment of a paperboard blank 100, i.e., pattern or layout, for forming a carton having an integrated pouch cup for meal preparation and consumption. The carton may be configured for holding food products which are intended to be reconstituted with water, such as, for example, instant soup, noodles, and oatmeal. As described in further detail below, the layout comprises formation panels and flaps (or tabs). The panels, generally speaking, become a major surface of the completed carton (e.g., front, back, sides, bottom, or top), whereas the flaps (or tabs) are mainly used to interconnect the panels. Although, the embodiments described herein are formed of paperboard, other materials may be used, such as, for example, paper, cardboard, fiberboard, plastic, composite materials, laminated paperboard, and corrugated variations of such materials.

The blank 100 has a main panel 110 with a perforated section 115 at a top portion thereof. A first side panel 120 adjoins the main panel 110 along a first fold line 125, which extends in a height direction of the main panel 110. The first side panel 120 has a perforated section 130 at a top portion thereof. A second side panel 140 adjoins the main panel 110 along a second fold line 145, which extends in the height direction of the main panel 110. The second side panel 140 is positioned on the side of the main panel 110 opposite the first side panel 120 in a width direction of the main panel 110. The second side panel 140 has a perforated section 150 at the top portion thereof. The first 120 and second side panels 140 are configured to at least partially overlap when folded onto the main panel 110.

A bottom panel 160 adjoins the main panel 110 along a third fold line 165, which extends in a width direction of the main panel 110. The bottom panel 160 is positioned on the bottom side of the main panel 110, i.e., the side opposite the perforated section 115 of the main panel. The bottom panel 160 includes two bottom sections (i.e., a first 167 and a second bottom section 169) having a crease 170 in between. The first bottom section 167 adjoins the main panel 110 at the third fold line 165. The bottom panel 160 also includes an attachment tab section 168 which extends from the second bottom section 169.

The bottom panel 160 has a width which is less than the width of the main panel 110 so as to form open edge portions 172 at a bottom edge of the main panel 110 on both sides of the bottom panel 160. The open edge portions 172 extend all the way to the first 125 and second fold lines 145. For example, the width of the bottom panel 160 may be between about one half and about two thirds of the width of the main panel 110. The open edge portions 172 have a combined width which is approximately equal to a length of the bottom panel 160 in a direction perpendicular to the third fold line 165.

The edges 174 of the bottom panel 160 may curve inward in a width direction of the bottom panel 160. The crease 170 of the bottom panel 160 is configured to fold in a direction opposite to a direction in which the first 120 and second side panels 140 fold along the first 125 and second fold lines 145.

The main panel 110 includes third 175 and fourth fold lines 180 which extend toward a top portion of the main panel 110 from starting points on both sides of the bottom panel 160 at a transition between the bottom panel 160 and the open edge portions 172. The third 175 and fourth fold lines 180 have angled and/or curved portions such that they end nearer to the first 125 and second fold lines 145, in a width direction of the main panel 110, than the starting points. In other words, the third 175 and fourth fold lines 180 begin at the corners of the bottom panel 160 (which is inset some distance from the first 125 and second fold lines 145) and extend upward and curve outward until they reach a point close to the first 125 and second fold lines 145. The upper ends of the third 175 and fourth fold lines 180 may terminate near an intersection of the first 125 and second fold lines 145 and the perforated section 115 of the main panel 110.

The first 120 and second side panels 140 include, respectively, fifth 182 and sixth fold lines 184 which are symmetric about the first 125 and second fold lines 145 relative to the third 175 and fourth fold lines 180, respectively. A first sidewall region 192 near the first fold line 125 and a second sidewall region 194 near the second fold line 145 (e.g., a region between the third 175 and fifth fold lines 182, and a corresponding region between the fourth 180 and sixth fold lines 184) are configured to become sidewalls of a carton in its deployed configuration.

The carton formed by the blank 100, in its deployed configuration, may have an approximately rectangular cross section, which is formed by the consumer pushing the first 125 and second fold lines 145 inward in the width direction of the main panel 110. In particular, the bottom of the carton may be substantially rectangular, i.e., the shape will be essentially rectangular except for some curvature or bowing of the sides which would ordinarily be expected to occur in a paperboard structure having the disclosed configuration.

Figure 4:
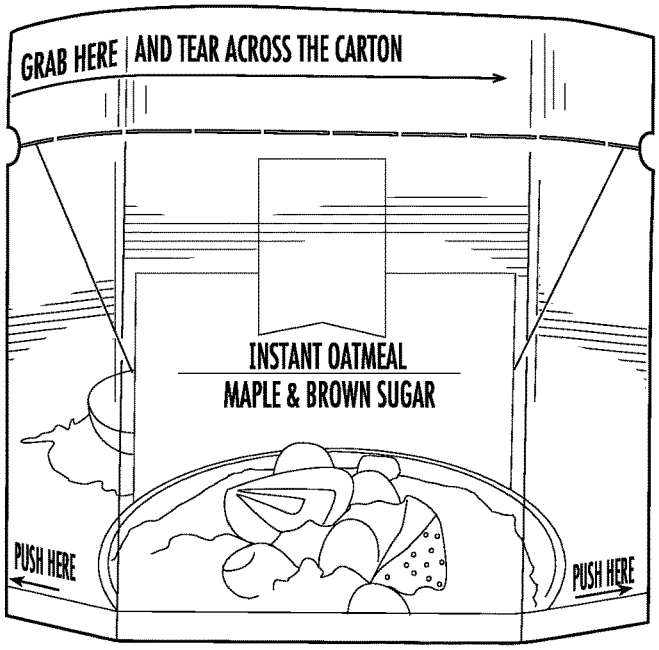
FIG. 4 is a front view of the carton of FIG. 1 in its undeployed configuration prior to being sealed.

FIG. 4 is a front view of the carton of FIG. 1 in its undeployed configuration prior to being sealed. The carton, when filled with product, remains substantially flat so that a large number of cartons with integrated pouch cups can be shelved in limited shelf space in retail stores.

Figure 5:
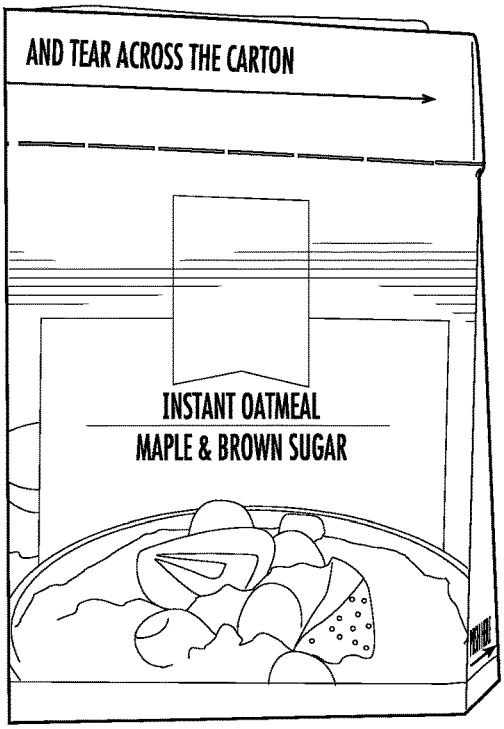
FIG. 5 is a front view of the carton of FIG. 1 in its deployed configuration prior to being filled and sealed.
Figure 20:
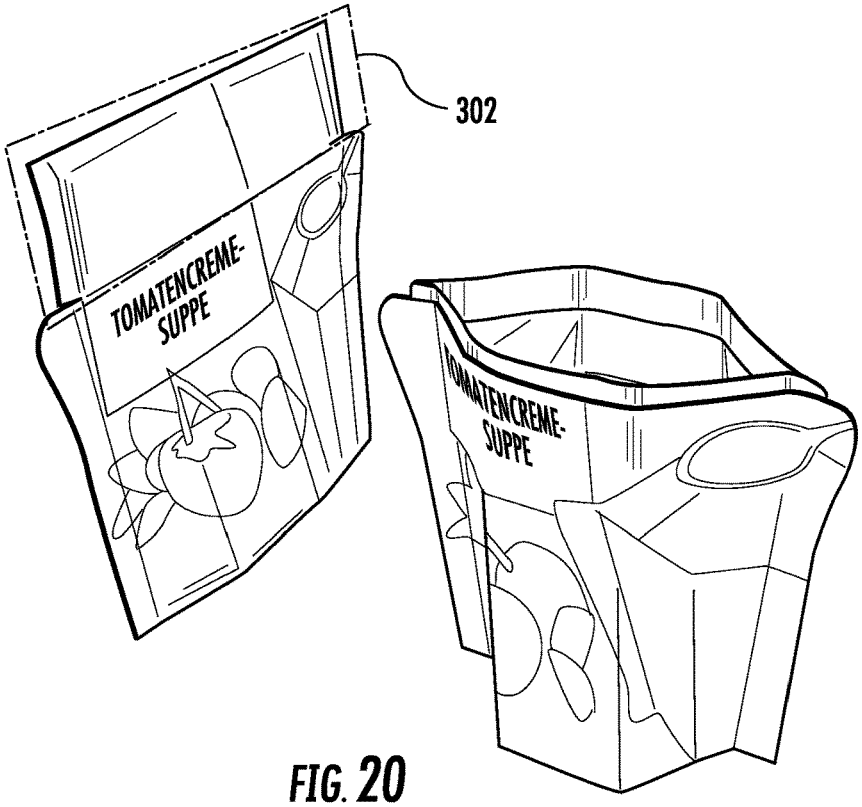
FIGS. 20 and 21 depict a conventional container having a pouch for the preparation and consumption of a food product.
Figure 21:
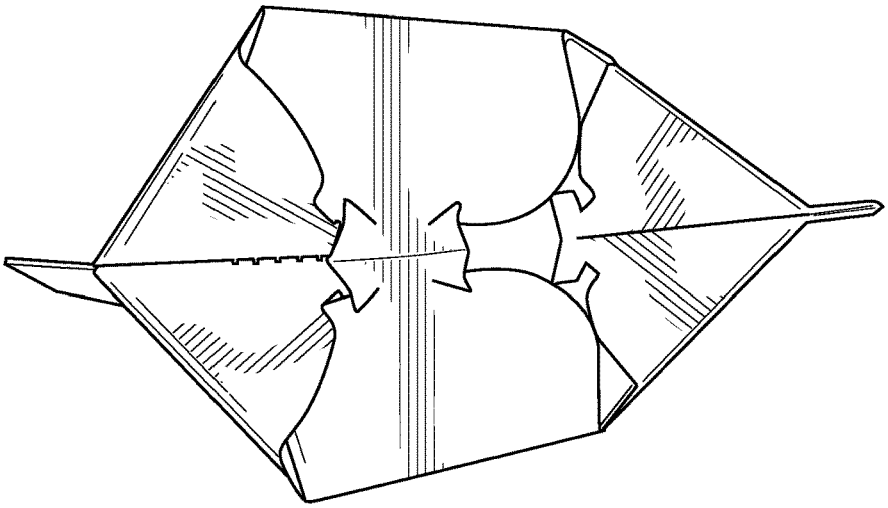

FIG. 5 is a front view of the carton of FIG. 1 in its deployed configuration prior to being filled and sealed. As can be seen from the figure, and unlike the collapsible-cup package of the prior art (see FIGS. 20 and 21), the entire width of the carton is used to form the interior volume of the deployed carton. In other words, in contrast to the prior art discussed below, there are no side portions or "wings" which remain flat when the carton is in its deployed configuration.

Figure 6:
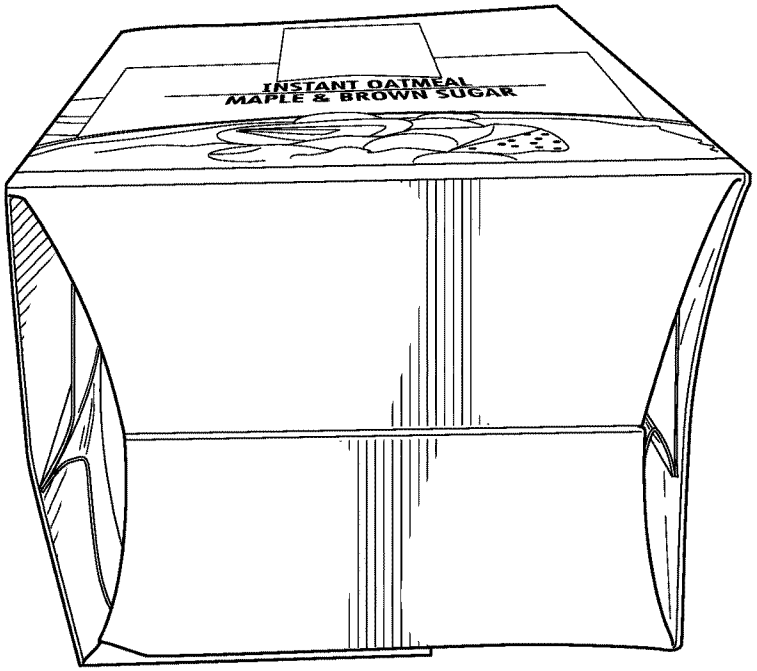
FIGS. 6 and 7 are bottom views of the carton of FIG. 1 in its deployed configuration.
Figure 7:
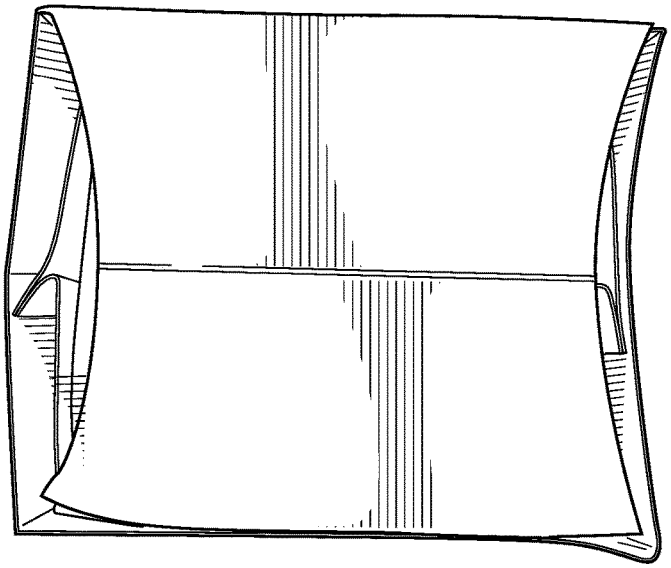

FIGS. 6 and 7 are bottom views of the carton of FIG. 1 in its deployed configuration. Significantly, the bottom of the carton is substantially flat and has a stable rectangular shape to sustain the standing posture of the pouch cup once it is assembled, i.e., deployed.

FIGS. 8-13 show a process for assembling the carton with the integrated pouch cup so as to incorporate a pouch containing a food product.

Figure 8:
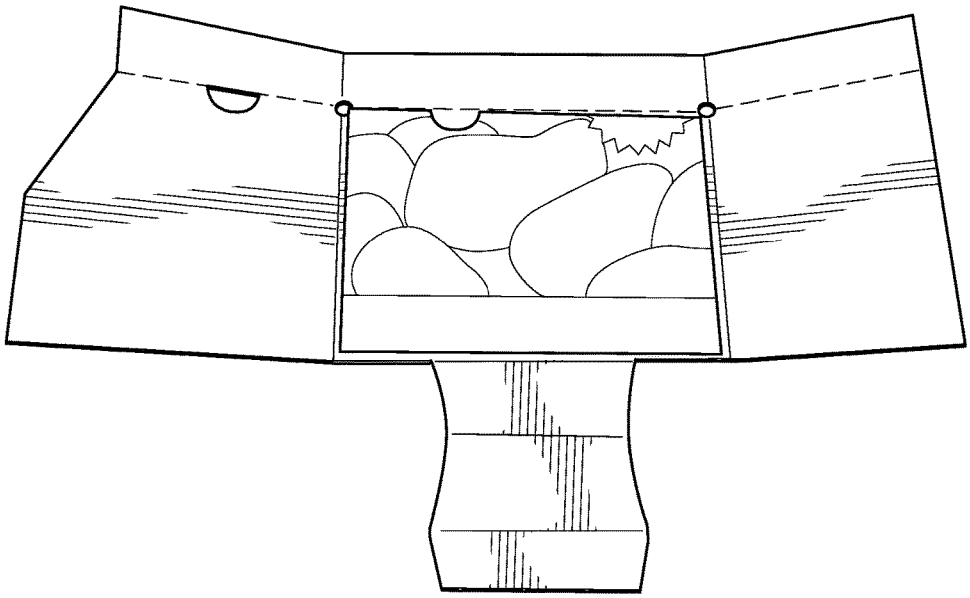
FIG. 8 depicts a blank for forming a carton having an integrated pouch cup, with a gusseted pouch containing a food product attached to a main panel thereof.

FIG. 8 depicts a blank for forming a carton having an integrated pouch cup, with a gusseted pouch containing a food product attached to a main panel thereof. A gusseted pouch containing a food product (e.g., fried chicken wings) is registered (i.e., accurately positioned) on a main panel of the blank used to form the carton with an integrated pouch cup. In some embodiments, the gusted pouch is glued, or otherwise attached to, the main panel.

Figure 9:
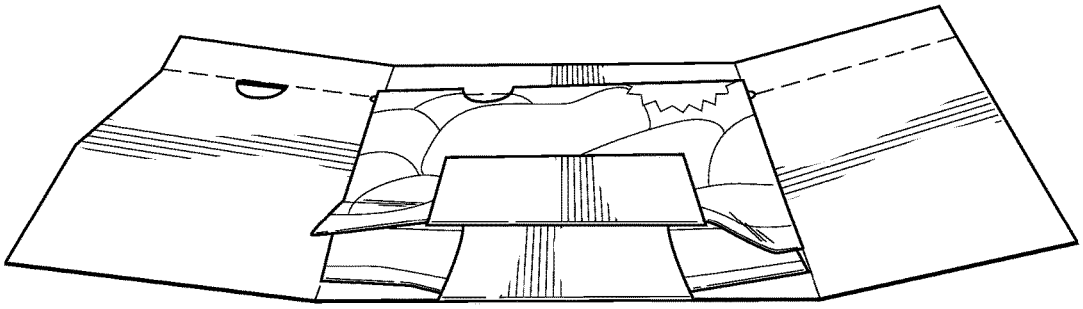
FIG. 9 depicts the blank of FIG. 8 with a bottom panel of the blank being folded and positioned within a gusset formed along an edge of the gusseted pouch.
Figure 10:
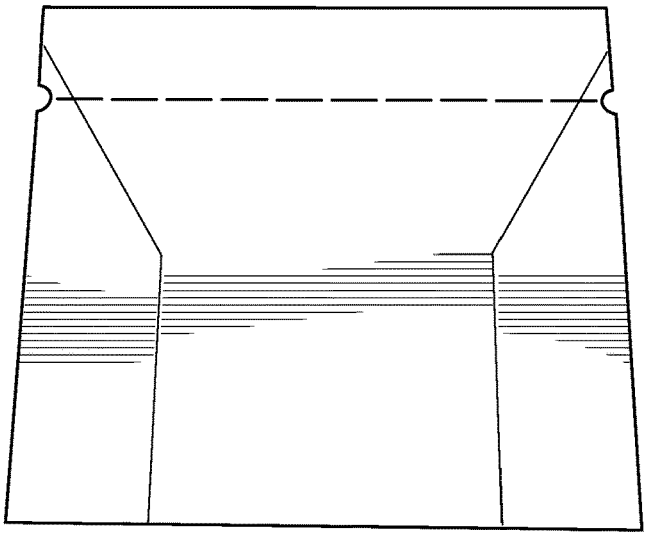
FIG. 10 depicts a carton formed from the blank of FIG. 8 by folding the side panels onto the main panel and adhering them to one another and sealing the perforated section at the top of the panels.
Figure 11:
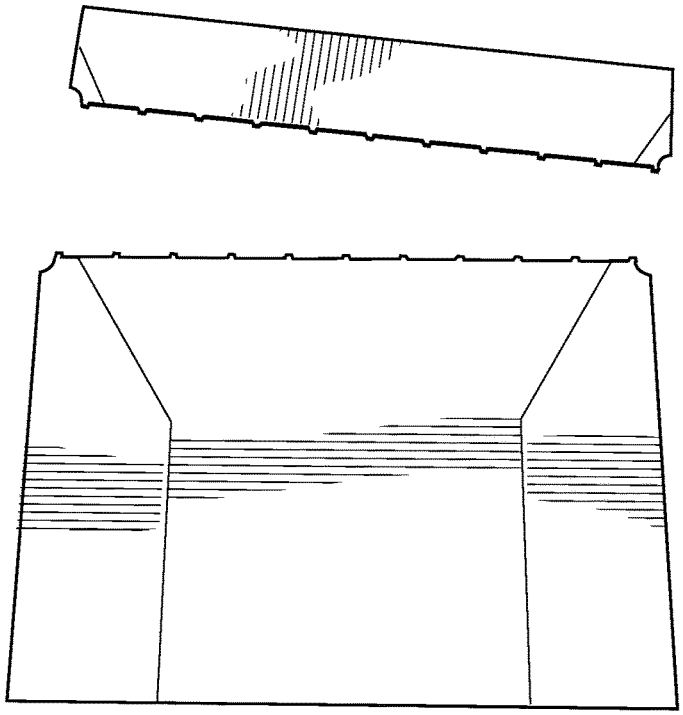
FIG. 11 depicts the carton of FIG. 10 after the perforated section at the top of the panels has been removed.

FIG. 9 depicts the blank of FIG. 8 with a bottom panel of the blank being folded and positioned within a gusset formed along an edge of the gusseted pouch. FIG. 10 depicts a carton formed from the blank of FIG. 8 by folding the side panels onto the main panel and adhering them to one another and sealing the perforated section at the top of the panels. FIG. 11 depicts the carton of FIG. 10 after the perforated section at the top of the panels has been removed.

Thus, as shown in FIG. 9, the gusseted pouch containing food product is integrated with the Z-folded paperboard outer sleeve when the bottom and side portions of the Z-folded paperboard sleeve are folded and glued (or sonically sealed) together (shown in FIG. 10). In some embodiments, a water-based heat-sealable coating or a polymer-based coating may be used. To use the integrated pouch cup, a consumer first removes the top portion (as shown in FIG. 11). In some embodiments, the top portions can be removed along a perforated line.

Figure 12:
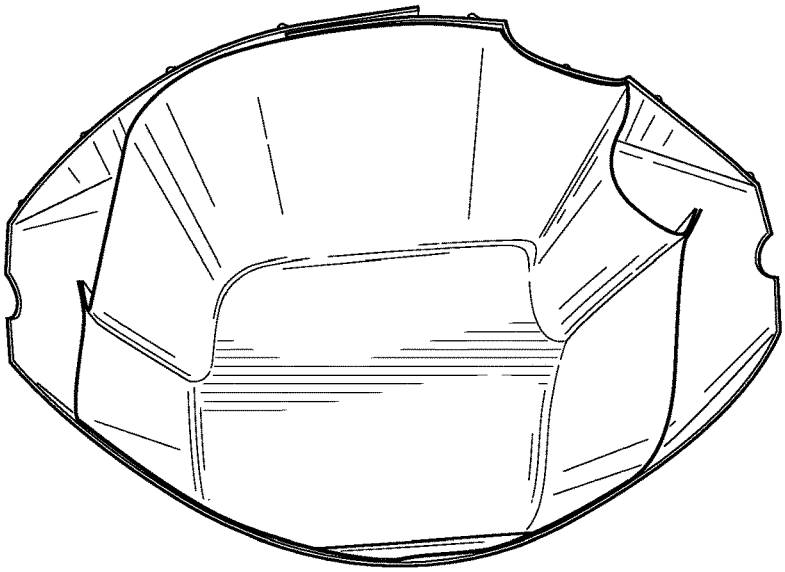
FIGS. 12 and 13 are top views of the carton of FIG. 10 in its opened and deployed configuration.
Figure 13:
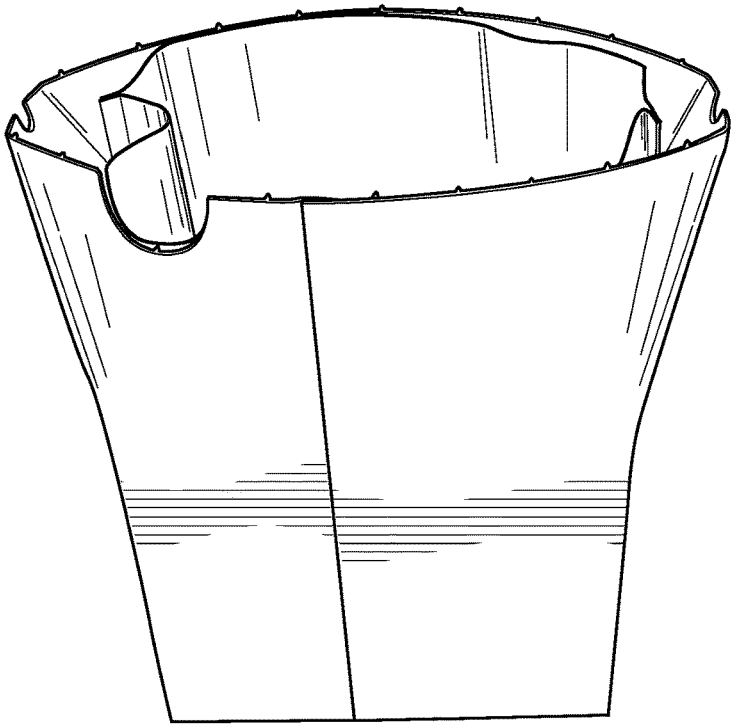

FIGS. 12 and 13 are top views of the carton of FIG. 10 in its opened and deployed configuration. The integrated pouch cup/bowl is formed, i.e., the carton is transformed into its deployed configuration, by the consumer when the consumer pushes the flat pouch at the sides to cause the flat package to expand open into a rectangular carton. Thus, the disclosed embodiments provide a carton having safe and stable base with a pouch inside that can, for example, be filled with water for reconstituting a food product, microwave preparation, and consumption of the food product.

In particular embodiments, the process of manufacturing the carton integrated pouch cup/bowl begins with the manufacture of the outer pre-formed Z-folded paperboard sleeve from a blank, e.g., the blank described above. The formation of the Z-folded paperboard sleeve and subsequent automated packaging and assembly is considered to be an innovative approach.

Figure 14:
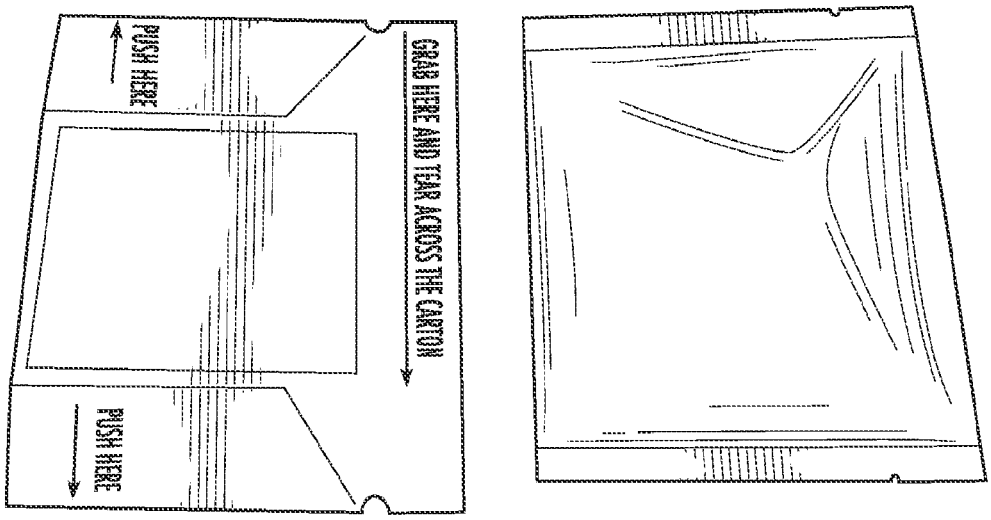
FIG. 14 depicts a carton having an integrated pouch cup and a gusseted pouch filled with product prior to insertion of the pouch during assembly of the carton.

FIG. 14 depicts a carton having an integrated pouch cup and a gusseted pouch filled with product prior to insertion of the pouch during assembly of the carton. In some embodiments, a premade or web-fed pouch is transferred into an articulating article bucket while the pre-formed Z-folded paperboard sleeve is formed in a parallel path and compressed slightly to bellow and allow insertion of the pouch. The premade or web fed pouch may be filled using conventional techniques, e.g., using fill seam systems with profiled product filling and dispersion to deliver a profiled and flat pouch.

Figure 15:
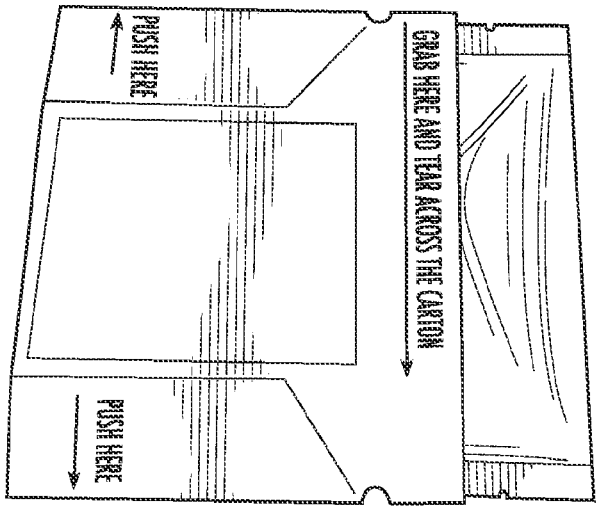
FIG. 15 depicts a carton having an integrated pouch cup and a gusseted pouch filled with product which is partially inserted into the carton.

FIG. 15 depicts a gusseted pouch filled with product which is partially inserted into the carton, i.e., the pouch is inserted into the pre-formed Z-folded paperboard sleeve. In some embodiments, the insertion is performed using a sliding article bucket that has a two-piece spatula-style base that allows the pouch to be stripped from the Z-folded paperboard sleeve after the insertion stroke is complete.

Figure 16:
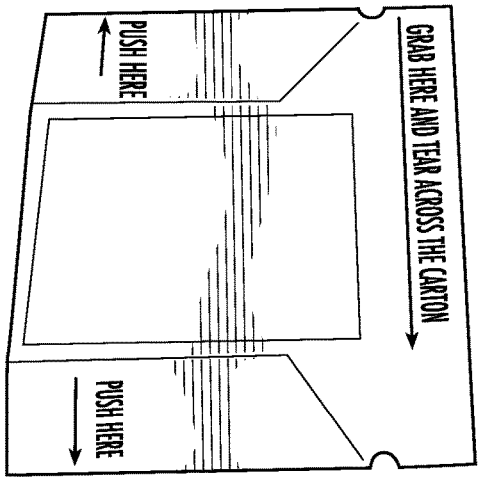
FIG. 16 depicts a carton having an integrated pouch cup and a gusseted pouch filled with product which is completely inserted into the carton.
Figure 17:
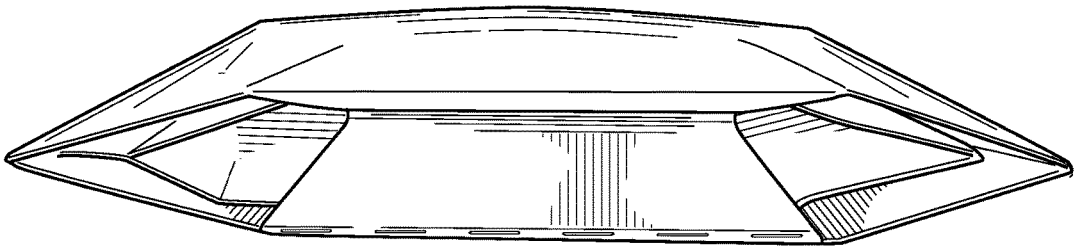
FIG. 17 depicts a carton having an integrated pouch cup and a gusseted pouch filled with product which is completely inserted into the carton so that the folded bottom panel of the carton is positioned in a gusset along an edge of the gusseted pouch.

FIGS. 16 and 17 depict a carton having an integrated pouch cup and the gusseted pouch filled with product once it is completely inserted into the carton. FIG. 17 shows that the folded bottom panel of the carton is positioned in a gusset along an edge of the gusseted pouch. The base of the Z-folded paperboard sleeve is prepared for insertion of the gusseted base of the pouch opposite the insertion station to allow for accurate pouch-to-sleeve registration.

Thus, the disclosed embodiments provide a method of forming a carton having an integrated pouch cup. The method is based on the use of a carton-forming blank as described above (e.g., the pre-formed Z-folded blank).

The method includes folding the first and second side panels onto the main panel so as to at least partially overlap and adhering the first and second panels to one another. The crease of the bottom panel is folded in a direction opposite to a direction in which the first and second side panels are folded along the first and second fold lines. The attachment tab section of the bottom panel is adhered to the first and second side panels (which have been adhered to one another).

Compression is applied to the first and second fold lines in a width direction of a panel to cause the blank to bellow, i.e., to create an interior space between the main panel and the adhered first and second side panels. A gusseted pouch is inserted into the interior space between the main panel and the adhered first and second side panels so that the crease of the bottom panel is positioned within a gusset along a bottom edge of the gusseted pouch. The positioning of the crease of the bottom panel may be aided by the insertion of a guide into the crease to hold it in position as the gusseted pouch is inserted into the carton.

Figure 18:
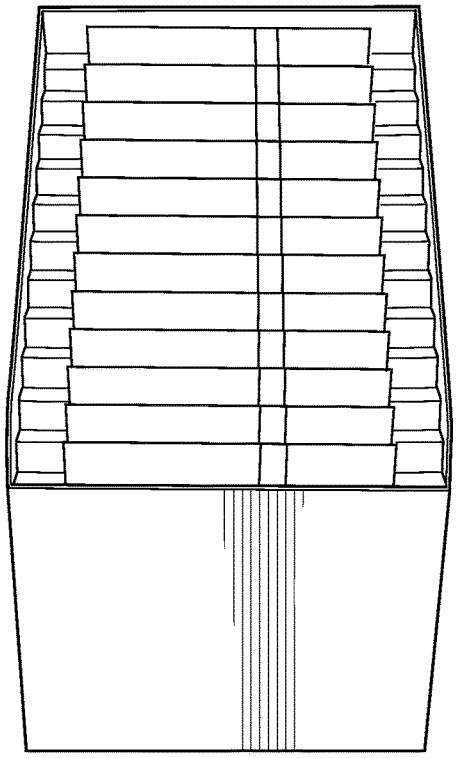
FIG. 18 depicts a retail shelf-ready distribution and shipping system containing a number of cartons, in accordance with the disclosed embodiments, in their closed and undeployed configuration.
Figure 19:
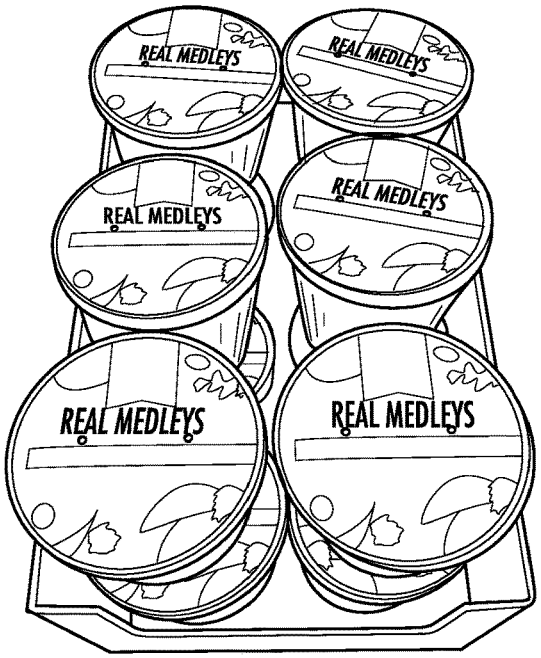
FIG. 19 depicts an arrangement of conventional cup containers for distribution of food products which are intended to be prepared and consumed in their retail container.

FIG. 18 depicts a retail shelf-ready distribution and shipping system containing a number of cartons, in accordance with the disclosed embodiments, in their closed and undeployed configuration. Thus, a number of the assembled cartons may be packed in a retail shelf-ready distribution and shipping systems, which delivers a significant cube, i.e., volume, utilization improvement for an estimated reduction of, e.g., 55% when compared to conventional cups and bowls that are commonly used across this category (see FIG. 19).

Although example embodiments have been shown and described in this specification and figures, it would be appreciated by those skilled in the art that changes may be made to the illustrated and/or described example embodiments without departing from their principles and spirit.

The invention claimed is:

1. A blank for forming a carton with an integrated pouch cup, the blank comprising:

a main panel having a width and a height, the main panel having a perforated section at a top portion thereof;

a first side panel adjoining the main panel along a first fold line, the first fold line extending in a height direction of the main panel, the first side panel having a perforated section at a top portion thereof;

a second side panel adjoining the main panel along a second fold line, the second fold line extending in the height direction of the main panel, the second side panel being positioned on a side of the main panel opposite the first side panel in a width direction of the main panel, the second side panel having a perforated section at the top portion thereof; and a bottom panel adjoining the main panel along a third fold line, the third fold line extending in a width direction of the main panel, the bottom panel being positioned on a side of the main panel opposite the perforated section of the main panel, the bottom panel comprising first and second bottom sections having a crease in between, the first bottom section adjoining the main panel at the third fold line, the bottom panel further comprising an attachment tab section which extends from the second bottom section, wherein the bottom panel has a width which is less than the width of the main panel so as to form open edge portions at a bottom edge of the main panel on both sides of the bottom panel, the open edge portions extending to the first and second fold lines.

2. The blank of claim 1, wherein the open edge portions have a combined width which is approximately equal to a length of the bottom panel in a direction perpendicular to the third fold line.

3. The blank of claim 1, wherein the main panel comprises third and fourth fold lines which extend toward a top portion of the main panel from starting points on both sides of the bottom panel at a transition between the bottom panel and the open edge portions, the third and fourth fold lines having angled and/or curved portions such that the third and fourth fold lines end nearer to the first and second fold lines, in a width direction of the main panel, than the starting points.

4. The blank of claim 3, wherein the first and second side panels comprise, respectively, fifth and sixth fold lines which are symmetric about the first and second fold lines relative to the third and fourth fold lines, respectively.

5. The blank of claim 4, wherein a first sidewall region between the third and fifth fold lines and a second sidewall region between the fourth and sixth fold lines are configured to become sidewalls of a carton, formed by the blank, by pushing the first and second fold lines inward in the width direction of the main panel to transform the carton into its deployed configuration to have an integrated pouch cup.

6. The blank of claim 1, wherein edges of the bottom panel curve inward in a width direction of the bottom panel.

7. The blank of claim 1, wherein the crease of the bottom panel is configured to fold in a direction opposite to a direction in which the first and second side panels fold along the first and second fold lines.

8. The blank of claim 1, wherein the first and second side panels are configured to at least partially overlap and adhere to each other when folded onto the main panel to form a carton.

9. The blank of claim 8, wherein a first sidewall region near the first fold line and a second sidewall region near the second fold line are configured to become sidewalls of the carton, formed by the blank, by pushing the first and second fold lines inward in the width direction of the main panel to transform the carton into its deployed configuration to have an integrated pouch cup.

10. The blank of claim 9, wherein the deployed carton formed by the blank has a substantially rectangular bottom.

11. The blank of claim 1, wherein the blank is formed of paper, cardboard, fiberboard, paperboard, plastic, composite material, or laminated paperboard.

12. A carton formed from a blank and having an integrated pouch cup, the carton comprising:

a main panel having a width and a height, the main panel having a perforated section at a top portion thereof;

a first side panel adjoining the main panel along a first fold line, the first fold line extending in a height direction of the main panel, the first side panel having a perforated section at a top portion thereof;

a second side panel adjoining the main panel along a second fold line, the second fold line extending in the height direction of the main panel, the second side panel being positioned on a side of the main panel opposite the first side panel in a width direction of the main panel, the second side panel having a perforated section at the top portion thereof; and a bottom panel adjoining the main panel along a third fold line, the third fold line extending in a width direction of the main panel, the bottom panel being positioned on a side of the main panel opposite the perforated section of the main panel, the bottom panel comprising first and second bottom sections having a crease in between, the first bottom section adjoining the main panel at the third fold line, the bottom panel further comprising an attachment tab section which extends from the second bottom section, wherein the bottom panel has a width which is less than the width of the main panel so as to form open edge portions at a bottom edge of the main panel on both sides of the bottom panel, the open edge portions extending to the first and second fold lines, and wherein the first and second side panels are folded onto the main panel so as to at least partially overlap and are adhered to one another.

13. The carton of claim 12, wherein the open edge portions have a combined width which is approximately equal to a length of the bottom panel in a direction perpendicular to the third fold line.

14. The carton of claim 12, further comprising a gusseted pouch positioned in an interior portion of carton.

15. The carton of claim 14, wherein the crease of the bottom panel is folded in a direction opposite to a direction in which the first and second side panels fold along the first and second fold lines so that the crease is positioned within a gusset along a bottom edge of the gusseted pouch.

16. The carton of claim 12, wherein a first sidewall region near the first fold line and a second sidewall region near the second fold line are configured to become sidewalls of the carton by pushing the first and second fold lines inward in the width direction of the main panel to transform the carton into its deployed configuration to have an integrated pouch cup.

17. The carton of claim 16, wherein the deployed carton has a substantially rectangular bottom.

18. A method of forming a carton having an integrated pouch cup, the method comprising:

providing a blank having:

a main panel having a width and a height, the main panel having a perforated section at a top portion thereof;

a first side panel adjoining the main panel along a first fold line, the first fold line extending in a height direction of the main panel, the first side panel having a perforated section at a top portion thereof;

a second side panel adjoining the main panel along a second fold line, the second fold line extending in the height direction of the main panel, the second side panel being positioned on a side of the main panel opposite the first side panel in a width direction of the main panel, the second side panel having a perforated section at the top portion thereof; and a bottom panel adjoining the main panel along a third fold line, the third fold line extending in a width direction of the main panel, the bottom panel being positioned on a side of the main panel opposite the perforated section of the main panel, the bottom panel comprising first and second bottom sections having a crease in between, the first bottom section adjoining the main panel at the third fold line, the bottom panel further comprising an attachment tab section which extends from the second bottom section, wherein the bottom panel has a width which is less than the width of the main panel so as to form open edge portions at a bottom edge of the main panel on both sides of the bottom panel, the open edge portions extending to the first and second fold lines;

folding the first and second side panels onto the main panel so as to at least partially overlap and adhering the first and second panels to one another;

folding the crease of the bottom panel in a direction opposite to a direction in which the first and second side panels are folded along the first and second fold lines;

adhering the attachment tab section of the bottom panel to the adhered first and second side panels;

applying compression to the first and second fold lines in a width direction of a panel to create an interior space between the main panel and the adhered first and second side panels; and inserting a gusseted pouch into the interior space between the main panel and the adhered first and second side panels so that the crease of the bottom panel is positioned within a gusset along a bottom edge of the gusseted pouch.

19. A method of forming a carton having an integrated pouch cup, the method comprising:

providing a blank having:

a main panel having a width and a height, the main panel having a perforated section at a top portion thereof;

a first side panel adjoining the main panel along a first fold line, the first fold line extending in a height direction of the main panel, the first side panel having a perforated section at a top portion thereof;

a second side panel adjoining the main panel along a second fold line, the second fold line extending in the height direction of the main panel, the second side panel being positioned on a side of the main panel opposite the first side panel in a width direction of the main panel, the second side panel having a perforated section at the top portion thereof; and a bottom panel adjoining the main panel along a third fold line, the third fold line extending in a width direction of the main panel, the bottom panel being positioned on a side of the main panel opposite the perforated section of the main panel, the bottom panel comprising first and second bottom sections having a crease in between, the first bottom section adjoining the main panel at the third fold line, the bottom panel further comprising an attachment tab section which extends from the second bottom section, wherein the bottom panel has a width which is less than the width of the main panel so as to form open edge portions at a bottom edge of the main panel on both sides of the bottom panel, the open edge portions extending to the first and second fold lines;

attaching a gusseted pouch to the main panel so that an area of the pouch falls entirely within an area of the main panel;

folding the first and second side panels over the gusseted pouch so as to at least partially overlap and adhering the first and second panels to one another;

folding the crease of the bottom panel in a direction opposite to a direction in which the first and second side panels are folded along the first and second fold lines so that the crease of the bottom panel is positioned within a gusset along a bottom edge of the gusseted pouch; and adhering the attachment tab section of the bottom panel to the adhered first and second side panels.

* * * * *